US008776779B2

(12) United States Patent
Johnston

(10) Patent No.: US 8,776,779 B2
(45) Date of Patent: Jul. 15, 2014

(54) FIREPLACE GRATE WITH V-BAR RIBS

(75) Inventor: Todd Johnston, Cartersville, GA (US)

(73) Assignee: Landmann USA, Fairburn, GA (US)

( * ) Notice: Subject to any disclaimer, the term of this patent is extended or adjusted under 35 U.S.C. 154(b) by 742 days.

(21) Appl. No.: 12/645,601

(22) Filed: Dec. 23, 2009

(65) Prior Publication Data

US 2011/0146658 A1 Jun. 23, 2011

(51) Int. Cl.
*F24B 1/193* (2006.01)

(52) U.S. Cl.
USPC ..... 126/540

(58) Field of Classification Search
USPC ..... 126/298, 505, 540, 544; D23/397, 398, D23/403, 407
See application file for complete search history.

(56) References Cited

U.S. PATENT DOCUMENTS

| | | | | | |
|---|---|---|---|---|---|
| 2,985,165 | A | * | 5/1961 | Peterson et al. | 126/541 |
| 3,362,395 | A | * | 1/1968 | Peterson | 126/92 R |
| 3,385,651 | A | * | 5/1968 | Rasmussen et al. | 431/328 |
| 3,682,158 | A | * | 8/1972 | Thomas | 126/540 |
| 4,086,905 | A | * | 5/1978 | Dawson | 126/505 |
| 4,140,102 | A | * | 2/1979 | Malecki | 126/541 |
| 4,360,001 | A | * | 11/1982 | Thompson | 126/541 |
| D267,223 | S | * | 12/1982 | Hassett et al. | D23/398 |
| D267,466 | S | * | 1/1983 | Hassett et al. | D23/398 |
| 4,611,573 | A | * | 9/1986 | Newman | 126/153 |
| 4,838,240 | A | * | 6/1989 | Rieger | 126/92 R |
| 4,862,871 | A | * | 9/1989 | Sieberth | 126/298 |
| 4,940,407 | A | * | 7/1990 | Rehberg et al. | 431/126 |
| D373,186 | S | * | 8/1996 | Bain | D23/398 |
| D400,243 | S | * | 10/1998 | Newman et al. | D23/409 |
| 6,799,406 | B2 | * | 10/2004 | Gosselin et al. | 52/694 |
| 6,820,610 | B2 | * | 11/2004 | Wright | 126/540 |
| 2009/0090348 | A1 | * | 4/2009 | Contarino, Jr. | 126/25 R |
| 2009/0151575 | A1 | * | 6/2009 | Eisendrath | 99/340 |

OTHER PUBLICATIONS

Online product page: "Landmann USA 23 in. Gelled Firestarter V-Bar Steel Fireplace Grate—Fireplace Accessories at Hayneedle" from Mar. 2013, Hayneedle.com.*

Online Google search results: "V-bar steel fireplace grate" with dates restricted to Jan. 1, 2004-Dec. 22, 2008.*

* cited by examiner

*Primary Examiner* — Avinash Savani
*Assistant Examiner* — Martha Becton
(74) *Attorney, Agent, or Firm* — Benjamin A. Balser; Balser & Grell IP Law

(57) ABSTRACT

A fireplace grate that is made from square bar steel and V-bar steel. The V-bars provide improved fire burning characteristics. The position of the V-bar ribs and how the V-bar ribs are made and bent offer these improved characteristics.

3 Claims, 2 Drawing Sheets

FIREPLACE GRATE WITH V-BAR RIBS

TECHNICAL FIELD

This disclosure relates to improvements for using a fireplace grate that burns firewood.

DETAILED DESCRIPTION

Figure 1:
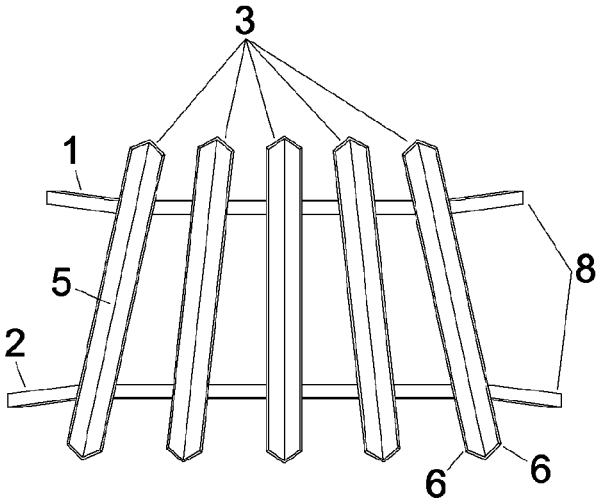
FIG. 1 is a plan view of the grate.

In FIG. 1, a plan view of the grate is shown. The grate is supported by a front leg 2 and a back leg 1. Both legs 1, 2 are tilted slightly outwards at point 8 to provide more stability whereas the distance between the legs is more at the ground than at the top of the leg. The legs 1, 2 are made from square bar steel.

Figure 3:
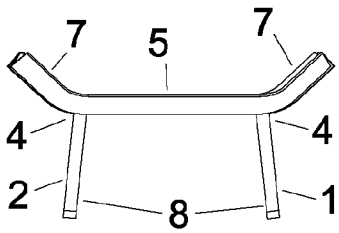
FIG. 3 is a side view of the grate.
Figure 5:
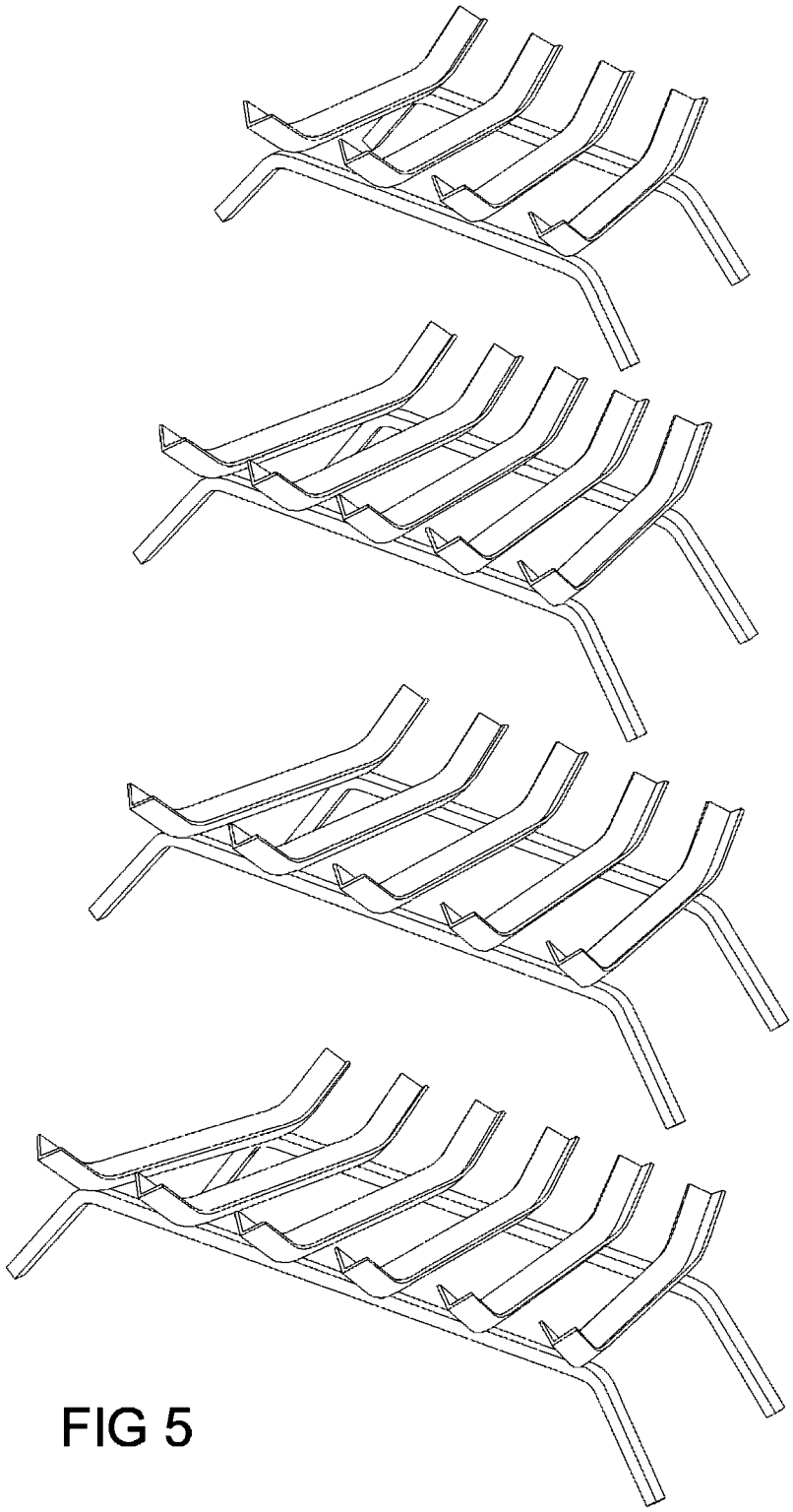
FIG. 5 is a perspective view of the grate showing the many sizes of V-bar grates that can be made but not restricted to the sizes shown.

Each V-bar rib 3 is assembled to the top of legs 1, 2 by welds 4 (FIG. 3). The number of V-bar ribs used is determined by the size of the grate. The bigger the grate, the more V-bar ribs used (FIG. 5). The V-bar ribs are welded 4 to the legs with spacing between each rib that is wider on the front leg and narrower on the back leg. (FIG. 1).

Figure 4:
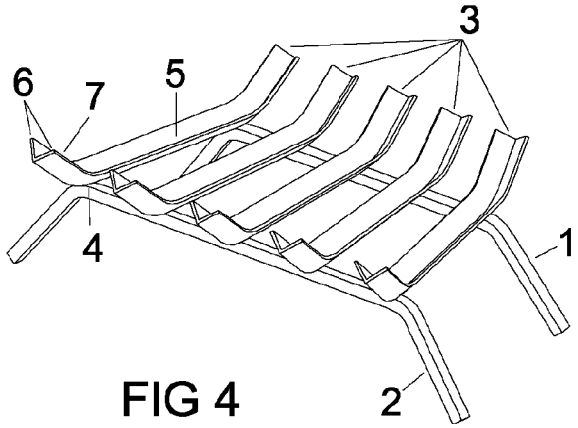
FIG. 4 is a perspective view of the grate.
Figure 2:
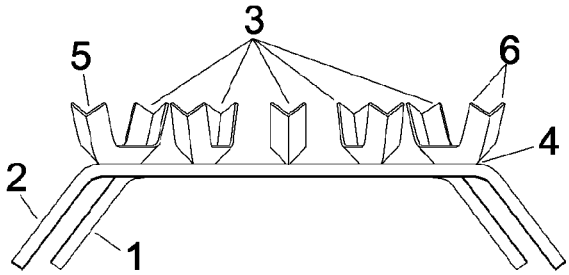
FIG. 2 is a front view of the grate.

FIG. 2 shows a front view of the grate. The length of the legs is determined by the size of the grate. The front leg is always wider than the back leg. The V-bar rib centers are welded to the top of the legs so the cavity 5 of the V-bar rib is upwards. Because both ends 7 of the V-bar are angled up, the tips of the V-bar become double pointed 6 (FIGS. 1, 2, 4).

Firewood is supported by the V-bar rib cavity 5, V-bar rib angled ends 7 and the V-bar double points 6 of the angled V-bar rib 3. Before using, firestarter is placed in the V-bar rib cavity 5. Firewood is then placed in the grate and the firestarter is lit using a match or lighter. The close proximity of the firestarter in the V-bar rib cavity 5 with the firewood will make starting fires less difficult.

An example embodiment includes a fireplace grate that has ribs made from V-bar steel. The shape of the V-bar allows the use of any firestarter to be used inside the V-bar cavity allowing easy starting of any type of firewood whether from nature or man made. The V-bar rib shape allows for more hold on the firewood. The V-bar is bent upwards on both ends which hold the firewood inside the grate. The upward bend of the V-bar rib end creates a double pointed tip for more hold with more points on the firewood. The V-bar ribs are welded to the legs in specific angles. The orientation of the V-bar is with the center down, cavity up. Overall size of the grate will vary along with the number of V-bars used.

Therefore, at least the following is claimed:

1. A fireplace grate, comprising:

a plurality leg assemblies wherein the plurality of leg assemblies comprise a first end support and a second end support, the first end support being wider in length than the second end support and the plurality of leg assemblies are parallel with each other; and a plurality of ribs having a first end and a second end and comprising continuously solid material attached to the plurality leg assemblies such that the spacing of adjacent ribs is greater at the first end of the ribs than the spacing of adjacent ribs at the second end, and each rib comprising a v-shaped cross-section oriented to form a cavity along the entire length of the rib from the first end to the second end; and wherein at least one of the first end or of the second end of at least one of the plurality of ribs is bent away from at least one of the plurality of leg assemblies.

2. The fireplace grate of claim 1, wherein the plurality of ribs are each welded to the plurality of leg assemblies.

3. The fireplace grate of claim 1, wherein plurality of ribs is evenly spaced across the plurality of leg assemblies.

* * * * *